US007140183B2

(12) United States Patent
Ruck et al.

(10) Patent No.: US 7,140,183 B2
(45) Date of Patent: Nov. 28, 2006

(54) PREMIXED EXIT RING PILOT BURNER

(75) Inventors: Thomas Ruck, Rekingen (CH); Sasha Savic, Wettingen (CH); Torsten Strand, Finspong (SE)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 11/036,107

(22) Filed: Jan. 18, 2005

(65) Prior Publication Data

US 2005/0164138 A1 Jul. 28, 2005

Related U.S. Application Data

(63) Continuation of application No. PCT/CH03/00530, filed on Aug. 5, 2003.

(30) Foreign Application Priority Data

Aug. 12, 2002 (EP) ..... 02405684

(51) Int. Cl.
*F02C 1/00* (2006.01)
*F02C 7/22* (2006.01)
*F02C 3/14* (2006.01)

(52) U.S. Cl. ..... 60/737; 60/748; 60/776

(58) Field of Classification Search ..... 60/776, 60/39.37, 737, 748, 804
See application file for complete search history.

(56) References Cited

U.S. PATENT DOCUMENTS 5,794,449 A 8/1998 Razdan et al.
5,954,495 A * 9/1999 Knopfel et al. ..... 431/285
6,152,726 A * 11/2000 Ruck et al. ..... 431/284
6,210,152 B1 * 4/2001 Haffner et al. ..... 431/12
6,363,725 B1 * 4/2002 Mei et al. ..... 60/737

FOREIGN PATENT DOCUMENTS

EP 0 321 809 6/1989
EP 0 704 657 4/1996
EP 0 780 629 6/1997
EP 0 797 051 9/1997

(Continued)

OTHER PUBLICATIONS

Copy of Search Report from EP 02405684.8 (Jan. 2, 2003).

(Continued)

*Primary Examiner*—Charles G. Freay
(74) *Attorney, Agent, or Firm*—Cermak & Kenealy, LLP; Adam J. Cermak

(57) ABSTRACT

A burner (24) which is useful for operating a heat generator includes a first upstream swirl generator (17) capable of swirling a combustion air stream, a device for injecting at least one fuel into the combustion air stream from the upstream swirl generator (17), an exit ring (1) located at the downstream end of the burner (24) at the edge to the combustion chamber (2) where the fuel is burnt, and preferentially a mixing section (20, 21) downstream from the upstream swirl generator (17) having a downstream end, having at least one transfer duct (20) for transferring downstream a flow of combustion air and fuel formed in the upstream swirl generator (17), and having a mixing tube (21) downstream from the at least one transfer duct (20) and receiving flow from the at least one transfer duct (20), wherein the downstream end of the mixing section borders the combustion chamber (2) and is formed by the exit ring (1). Pilot mode operation of such a burner (24) is advantageously and economically made possible by providing a pilot burner system (8, 15, 28, 35) in the exit ring (1) for injecting liquid fuel (27) into the combustion chamber (2).

23 Claims, 5 Drawing Sheets

FOREIGN PATENT DOCUMENTS

| | | |
|---|---|---|
| EP | 0 833 104 | 4/1998 |
| EP | 0 931 980 | 7/1999 |
| EP | 0 994 300 | 4/2000 |
| EP | 1 058 062 | 12/2000 |
| EP | 1 070 914 | 1/2001 |
| EP | 1 199 522 | 4/2002 |

OTHER PUBLICATIONS

Copy of International Search Report from PCT/CH03/00530 (Oct. 6, 2003).

Copy of International Preliminary Examination Report from PCT/CH03/00530 (Jul. 27, 2004).

* cited by examiner

PREMIXED EXIT RING PILOT BURNER

This application is a Continuation of, and claims priority under 35 U.S.C. § 120 to, International application No. PCT/CH03/00530, filed 5 Aug. 2003, and claims priority under 35 U.S.C. § 119 to EPO patent application No. 02405684.8, filed 12 Aug. 2002, the entireties of both of which are incorporated by reference herein.

BACKGROUND OF THE INVENTION

1. Field of the Invention

The present invention relates to a burner useful for operating a heat generator including a first upstream swirl generator capable of swirling a combustion air stream, means for injecting at least one fuel into the combustion air stream from the upstream swirl generator, an exit ring located at the downstream end of the burner at the edge to the combustion chamber where the fuel is burnt.

2. Brief Description of the Related Art

Premixed burners are characterized by a particularly low emission of $NO_x$ if operated under lean conditions. Correspondingly, these burners are operated under lean conditions at standard load. If the load is reduced, these burners have the tendency to become unstable when the supply with fuel is reduced.

A premixed burner is e.g. proposed in EP 0 321 809 B1, comprising several conical wall portions which are shifted with respect to each other leaving entrance slots through which the combustion air is entering the interior of the burner. Liquid and gaseous fuels can be burnt in such a premixed burner, preferentially liquid fuel is injected by means of a central fuel nozzle located on the axis of the burner, while gaseous fuels can be added to the stream of combustion air at the entrance slots between the conical wall portions.

An alternative premixed burner, which is described in e.g. EP 0 704 657 A2, or in EP 0 780 629 A2, additionally comprises a mixing tube located downstream of a burner as described in EP 0 321 809 B1, wherein at the entrance of the mixing tube there are transfer ducts for a controlled entrance of the swirling combustion air into the mixing tube.

To allow reduction of the fuel supply without the above-mentioned problems, a so-called pilot mode is made possible for such burners by providing particular pilot nozzles at the central fuel nozzle or by providing particularly long central fuel nozzles. Alternatively, as described in EP 0 797 051 A2, pilot mode can be made possible by providing, next to the burner, on the backside wall of the combustion chamber and distanced from the exit of the burner, separate mixing elements for fuel and combustion air which can be used for pilot operation of the burner. Another possibility for pilot operation is described in EP 0 994 300 A1, where a burner according to EP 0 704 657 A2 or EP 0 780 629 A2 is provided with an exit ring comprising swirl generators, and where pilot gas is injected into the combustion chamber into the swirl formed by these swirl generators. Yet another alternative for pilot operation is described in EP 0 931 980 A1, where pilot gas is injected next to the exit ring into the combustion chamber after mixing it with combustion air. Additionally, means for igniting the pilot gas are described in this document.

SUMMARY OF THE INVENTION

One aspect of the present invention is therefore to provide an alternative versatile burner which allows pilot operation.

In particular pilot operation can be provided for a burner useful for operating a heat generator including a first upstream swirl generator capable of swirling a combustion air stream, means for injecting at least one fuel into the combustion air stream from the upstream swirl generator, an exit ring located at the downstream end of the burner at the edge to the combustion chamber where the fuel is burnt. An example of such a burner is a double-cone burner as described in EP 0321 809 B1.

Examples embodying principles of the present invention address the above problem by providing a pilot burner system located in or at the exit ring for injecting liquid fuel into the combustion chamber. Surprisingly, it is possible to use the exit ring also for locating a pilot burner system for liquid fuel. It is known to locate pilot burner systems for pilot gas in the exit ring, but so far it has never been envisaged to modify such a pilot burner system for pilot gas to be used with liquid fuel in pilot mode, since problems arising with the enormous heat in these regions under normal load conditions did not allow it. The possibility to use liquid fuel for pilot mode is particularly interesting for industrial gas turbines where flexibility with respect to various fuels is a central issue. Additionally, the use of oil in pilot mode makes ignition easier, as igniting liquid fuel is usually easier than the ignition of pilot gas. Furthermore, in contrast to oil pilot nozzles according to the state-of-the-art, the proposed liquid pilot system does not have to be purged with purging air once the operation is shifted from idle to full load. At full load conditions the oil pilot system can be still used (<5% oil pilot) to enhance flame stabilisation. Therefore there is no need to shut these nozzles and by doing so, no purging is necessary. This decreases the time delay between different operation modes. Locating the oil injection on the exit ring and injecting the liquid pilot fuel directly into the combustion chamber reduces the danger of flashback occurrence.

In a first exemplary embodiment of the present invention the burner is further characterized in that a mixing section is provided downstream from the upstream swirl generator having a downstream end, having at least one transfer duct for transferring downstream a flow of combustion air and fuel formed in the upstream swirl generator, and having a mixing tube downstream from said at least one transfer duct and receiving said flow from said at least one transfer duct, wherein said downstream end of said mixing section is bordering the combustion chamber and is formed by said exit ring. The pilot burner system can thus be used advantageously also in case of premixed burners with mixing tube, as for example described in EP 0 704 657 A2 or EP 0 780 629 A2.

Preferably, the liquid fuel is injected in a plane comprising the axis of the mixing tube. The jet of liquid fuel is preferentially tilted away from said axis by an angle in the range of 15 to 60 degree, preferentially by an angle in the range of 25 degrees. It thus proofs advantageous not to direct the jet into the main stream exiting the burner, but rather to direct it away from the axis of the burner.

Various structures of exit rings can be used for locating such a pilot burner system. However, particularly advantageous are exit rings comprising a conical, tilted front surface facing away from the burner axis to the combustion chamber, and that the liquid fuel is injected through at least one, preferentially only one, hole in said tilted front surface. With respect to the general flow conditions at the exit of the burner, preferentially injection is directed along an axis orthogonal to the tilted front surface. It could be shown that providing one pilot nozzle per burner is sufficient for maintaining stable pilot operation, in particular if the nozzles of neighbouring burners in a combustion chamber are oriented properly with respect to each other.

According to still another exemplary embodiment of the invention, the burner is characterized in that liquid fuel is delivered to the pilot burner system by means of a tube, in that a nozzle is located at the downstream end of said tube, through which the liquid fuel is ejected, and in that means are provided to guide air to holes in the exit ring through which holes the jet generated by said nozzle is entering the combustion chamber. Exemplarily, the means to guide air to the terminal end of the burner is including an annular air channel in the exit ring. The provision of air flowing around the nozzle and shielding the spray cools down the nozzle surface and prevents its overheating in particular in full load conditions.

Yet another exemplary embodiment of the present invention is characterised in that upstream of said nozzle in the tube there is located means for generating turbulence in the flow of liquid fuel in the tube. These means for generating turbulence increase the opening angle of the jet of liquid fuel, which improves the mixing between combustion air and liquid fuel. Preferentially, the means are provided as at least one turbulence generator with at least two holes through which the liquid fuel has to pass. Like this, turbulence is generated in a particularly easy way within the tube.

According to another exemplary embodiment of the invention, said nozzle is located in a tilted endplate terminating the tube, which endplate is preferentially substantially parallel to the above-mentioned tilted front surface of the exit ring. The endplate can be an end cone extending into the hole downstream of the tube, wherein the axis of the cone is substantially aligned with the axis of the hole. By using a conical endplate, the actual position of the discharge of the liquid fuel out of the nozzle can be moved closer to the exit of the hole in the exit ring, thereby preventing that the jet of fuel is for example deflected by the air shielding the jet pushing it on to a wall of the hole.

According to a further exemplary embodiment of the invention, the exit ring additionally has a second pilot burner system for injecting pilot gas into the combustion chamber, wherein preferentially said second pilot burner system is also located in the exit ring and comprises several injection locations distributed circumferentially around a conical, tilted front surface of the exit ring facing away from the burner axis. The combination of the proposed pilot burner system for liquid fuels with a pilot burner system for pilot gas, which is very often already available in the same exit ring, allows, by means of an easy modification of such a pilot gas system, to enhance the versatility of the burner substantially.

The present invention additionally relates to an annular combustion chamber of a gasturbine unit, which is characterized in that at least two, preferentially at least ten burners, as described above, are arranged within the combustion chamber. Exemplarily, such an annular combustion chamber is characterised in that the burners each have one nozzle for injecting liquid fuel for pilot operation, wherein preferentially the radial position of said nozzle within each burner with respect to the radial position of each burner within the annular combustion chamber is the same for all nozzles/burners. Such an arrangement of the nozzles of the burners in an annular combustion chamber optimizes the stability of pilot operation, since due to the outside swirl direction within the annular combustion chamber, the oil pilot flame shapes of neighbouring burners overlap optimally. Thereby the cross ignition properties can be increased in pilot mode.

The present invention furthermore relates to a method for operating a burner in a heat generator in pilot mode, wherein the burner has a first upstream swirl generator capable of swirling a combustion air stream, means for injecting at least one fuel into the combustion air stream from the upstream swirl generator, an exit ring located at the downstream end of the burner at the edge to the combustion chamber where the fuel is burnt, and preferentially a mixing section provided downstream from the upstream swirl generator having a downstream end, having at least one transfer duct for transferring downstream a flow of combustion air and fuel formed in the upstream swirl generator, and having a mixing tube downstream from said at least one transfer duct and receiving said flow from said at least one transfer duct, wherein said downstream end of said mixing section is bordering the combustion chamber and is formed by said exit ring. The method is characterized in that liquid fuel is injected from the exit ring into the combustion chamber. Preferentially, a burner as it is described above is used.

Additionally, a method for operating an annular combustion chamber of a gasturbine unit in pilot mode is proposed, which is characterized in that an annular combustion chamber as described above is used, and in that each of the nozzles is substantially equally supplied with liquid fuel.

BRIEF DESCRIPTION OF THE DRAWING FIGURES

In the accompanying drawings exemplary embodiments of the invention are shown in which.

DETAILED DESCRIPTION OF EXEMPLARY EMBODYMENTS

Figure 1:
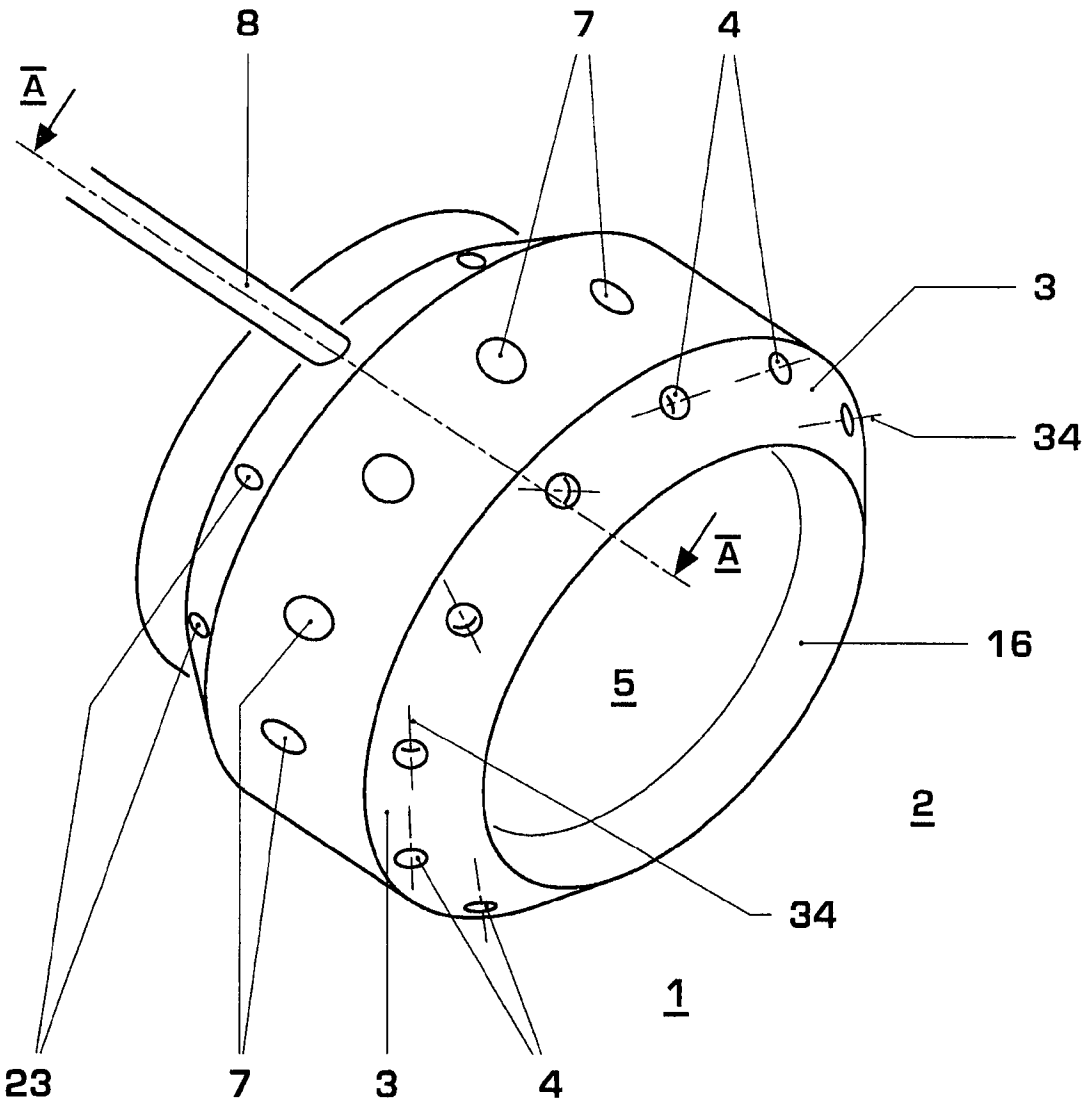
FIG. 1 shows a perspective view of an exit ring.

Referring to the drawings, which are for the purpose of illustrating the present exemplary embodiments of the invention and not for the purpose of limiting the same, FIG. 1 shows a perspective view of an exit ring 1. On the lower right-hand side, there is, if the burner is mounted, the combustion chamber 2. On the upper left-hand side, a mixing tube is located. The exit ring 1 comprises a tilted front surface 3, which is facing away from the stream of combustion air/fuel which in operation exits the burner. Facing the stream of combustion air/fuel which exits the cavity 5 of the mixing tube, there is a in rounded inner surface 16. This rounded surface 16 gives a breakaway edge which stabilizes and enlarges the back flow zone forming in the downstream region of the burner. For more details, reference is made to EP 0 780 629 A2, which disclosure is incorporated herein.

The exit ring 1 is provided with a pilot burner system for use with pilot gas as well as with a pilot burner system for use with liquid fuel, i.e. with pilot oil. For the purpose of operating the burner with pilot gas, a number of holes 4 (16 holes) is provided on the tilted surfaces 3 of the exit ring 1. The axis 34 of these holes is substantially perpendicular to the plane of the surface 3. Only one of these holes 4 is being used for pilot oil operation, namely the one that is connected to the tube 8 for pilot oil (the one crossed by the line A—A in FIG. 1). To supply the pilot fuel with combustion air, there is provided particular pathways to guide this air to the holes 4. This air subsequently enters the interior of the exit ring by means of the entrance holes 7.

Figure 2:
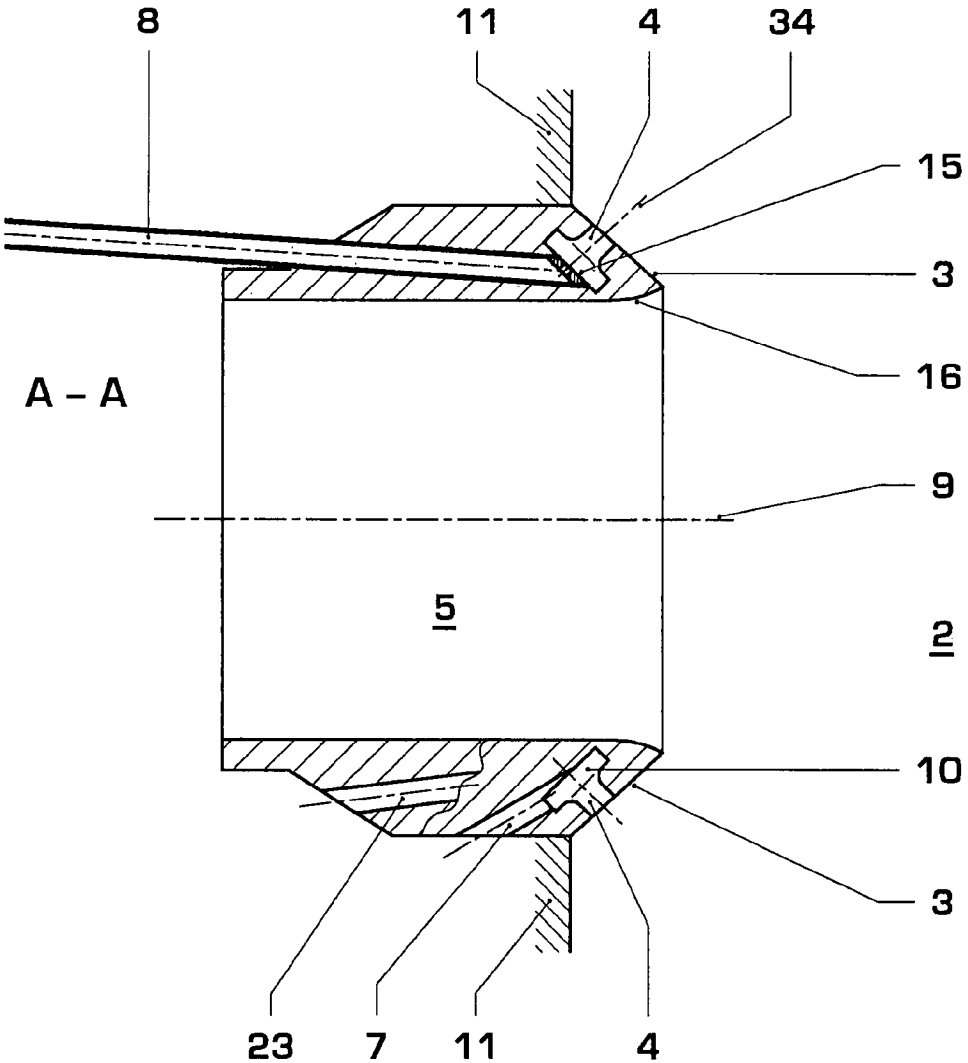
FIG. 2 shows an axial cut along the line A—A in FIG. 1, i.e., in a position where there is a tube for pilot oil.

FIG. 2 shows an axial cut through an exit ring 1 along the line A—A as indicated in FIG. 1. On the top, the cut passes through the pilot oil supply system. The tube 8 goes straight into the exit ring to end at one of the holes 4. In the terminal region of the exit ring 1, i.e. underneath the tilted surface 3, there is an annular air channel 10 from which the holes 4 branch off. The tube 8 terminates in a tilted endplate 15, which is aligned substantially parallel to the surface 3 and substantially orthogonal to the axis 34 of the hole 4. Also visible in FIG. 2 is the position of the backside wall 11 of the combustion chamber 2, which is staggered backwards with respect to the front end of the exit ring 1.

On the bottom side of FIG. 2, the flow of pilot gas 26 can be seen. The pilot gas 26 is supplied by a tube 23 to the exit ring 1 to enter an annular duct (not shown) for pilot gas, which serves to distribute the pilot gas into the annular air channel 10. The pilot gas is mixed with the air flowing in the annular air channel 10 and is then, as a mixture of gas/air, exiting the hole 4 into the combustion chamber 2. The ducts for the pilot gas 26 alternate with the holes 7 for the air and the axial connections to the annular air channel 10 along the circumference of the exit ring 1.

Figure 3:
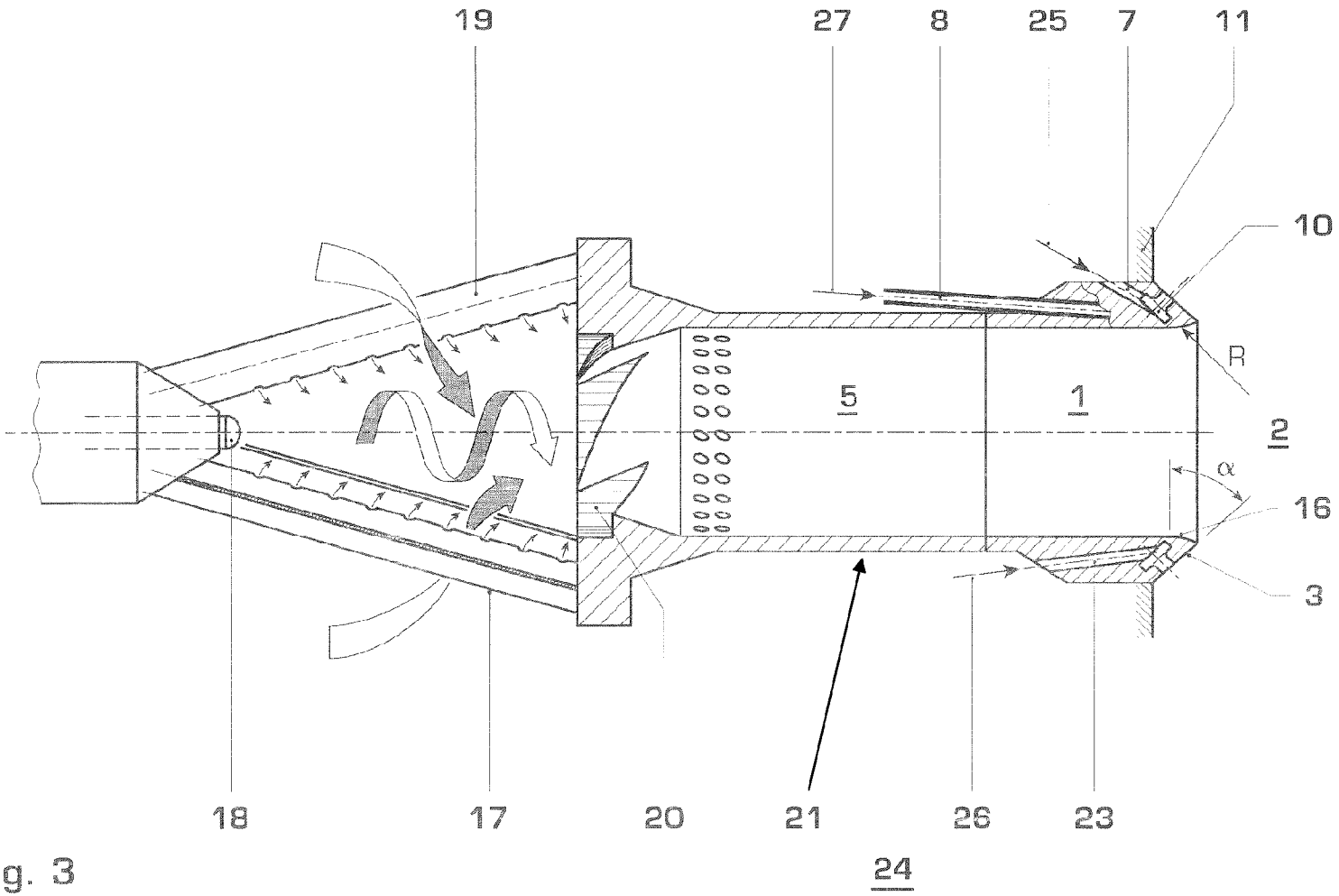
FIG. 3 shows a schematic, axial cut through a double cone burner with mixing tube.

FIG. 3 displays a cut through a double cone burner 24 with mixing tube. Such a burner is for example described in EP 0 780 629 A2. The burner 24 comprises a double cone burner 17 as a first upstream swirl generator capable of swirling a combustion air stream. The combustion air stream enters the cavity of the double cone burner 17 via entrance slots 19 provided between the cones. Gaseous fuel is usually introduced into the combustion air stream in the region of the entrance slots 19. Liquid fuel is generally introduced into the cavity of the burner by means of a central oil nozzle 18 located on the axis 9 of the burner. Downstream of the double cone burner 17 there are transfer ducts 20, which serve to guide the swirl generated in the double cone burner 17 into the mixing tube 21. The terminal end of the mixing tube 21 is formed by the exit ring 1. The tilted front surface 3 of the exit ring 1 is tilted with respect to the backside wall 11 of the combustion chamber 2 by an angle $\alpha$, which is generally in the range of about 25 degrees. Additionally, the rounded inner surface 16 is displayed in detail in this figure.

Figure 4:
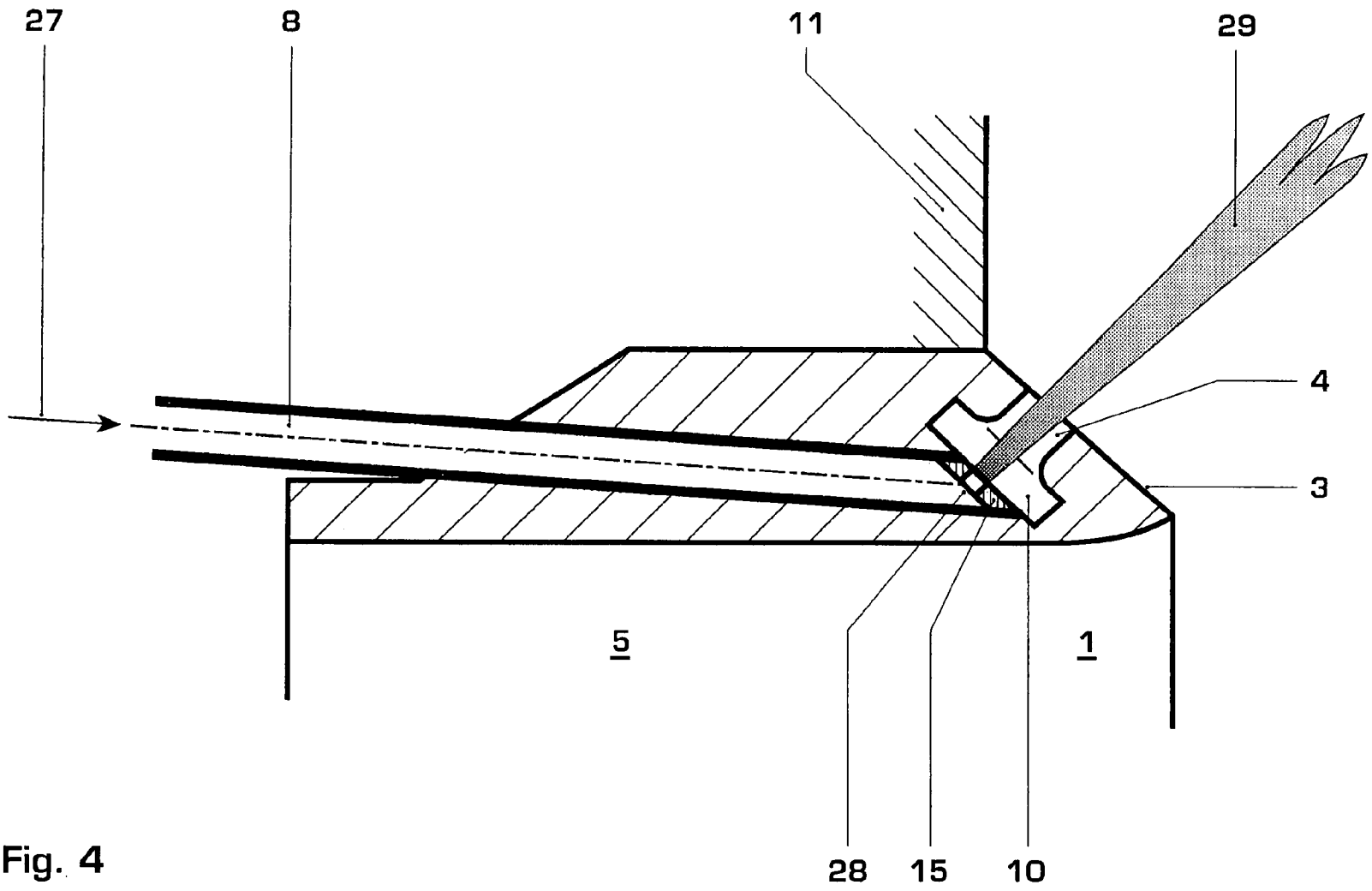
FIG. 4 shows in detail the path of pilot oil in an exit ring including the jet of oil.

FIG. 4 shows in more detail, how the pilot oil 27 is guided to the tilted endplate 15 which terminates the tube 8. The tilted endplate is aligned substantially parallel to the tilted surface 3. In a central position, aligned with the axis 34 of the hole 4, the tilted endplate 15 comprises a hole, i.e. a nozzle 28, through which the pilot oil is ejected first into the hole 4 and then into the combustion chamber 2 in a jet 29. The hole 28 may be cylindrical, but also conical shapes are possible opening or closing towards the exit. The ratio diameter/length of these bores 28 is preferably chosen in the range of 0.25 to 0.75, and the diameters range between 0.5 to 0.6 or even 0.75. To increase the opening angle of the jet 29, turbulences can be introduced in the tube 8, e.g. by inserting a turbulence generator into tube 8.

Figure 5:
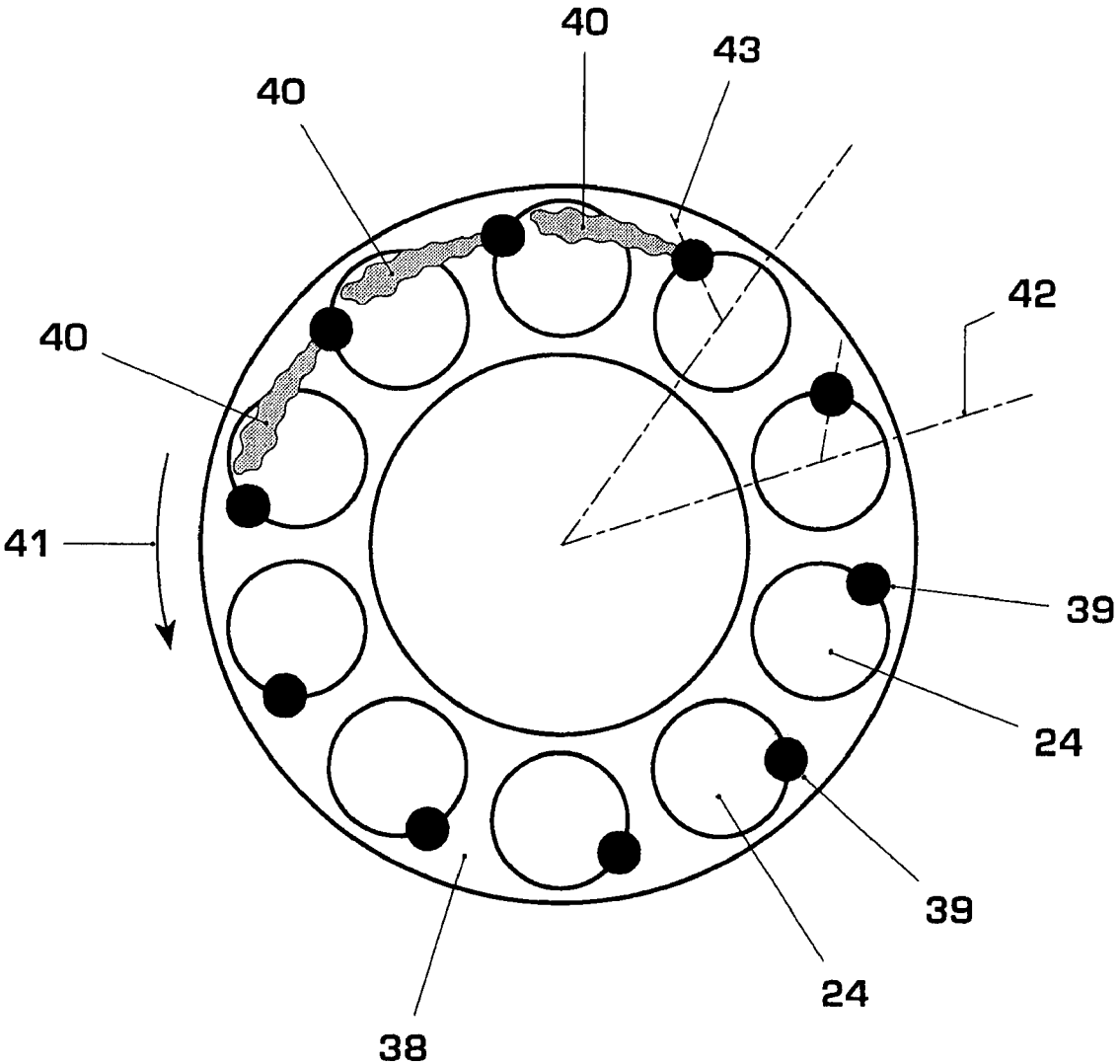
FIG. 5 shows a circular arrangement of burners in an annular combustion chamber displaying the relative positioning of the pilot oil injection.

FIG. 5 shows an arrangement of burners 24 in an annular combustion chamber of a gasturbine. Ten burners 24 are arranged on a circle, and each of the burners is equipped with one pilot oil injection nozzle 39. To have optimum cross ignition properties in pilot mode, the injection positions 39 are arranged in the rotationally symmetric way in the combustion chamber 38. That means that each injection position 39 has the same radial position 43 with respect to the radial position 42 of a burner within the annular combustion chamber 38. If the injection positions 39 are located like this respectively, the oil pilot flame shape 40 overlaps optimally for neighbouring burners due to the outside swirl direction 41 present in such an annular combustion chamber 38. Like this the cross ignition properties in pilot mode are substantially enhanced.

LIST OF REFERENCE NUMERALS

1 exit ring
2 combustion chamber
3 tilted front surface of 1
4 holes for pilot flame
5 cavity of mixing tube
7 entrance holes for air supply
8 tube for pilot oil
9 axis of the burner
10 annular air channel
11 backside wall of the combustion chamber
15 tilted endplate of 8
16 rounded inner surface of 1
17 double cone burner, swirl generator
18 central oil nozzle
19 entrance slot between the cones of 17
20 transfer ducts
21 mixing tube, mixing length
23 tube for pilot gas
24 double cone burner with mixing tube
25 air
26 pilot gas
27 pilot oil
28 nozzle in 15
29 jet of 26 injected into combustion chamber
31 carrier plate of 30
32 hole in 30
33 central portion of 30
34 axis of 4
35 tilted end cone of 8
36 radial shift of 8
37 changed air channel geometry
38 annular combustion chamber
39 position of the pilot oil injection
40 oil pilot flame shape
41 outside swirl direction
42 radial position of a burner within the annular combustion chamber
43 radial position of a pilot oil injection within one burner
$\alpha$ tilt angle of 3
R radius of 16
L length of mixing tube
T thickness of 15
A displacement of 30
B inner diameter of 8
C thickness of 30
D diameter of 28
E thickness of carrier plate
F diameter of 32

While the invention has been described in detail with reference to exemplary embodiments thereof, it will be apparent to one skilled in the art that various changes can be made, and equivalents employed, without departing from the scope of the invention. Each of the aforementioned documents is incorporated by reference herein in its entirety.

What is claimed is:

1. A burner useful for operating a heat generator, the burner comprising:

a first upstream swirl generator configured and arranged for swirling a combustion air stream;

means for injecting at least one fuel into the combustion air stream from the upstream swirl generator;

an exit ring located at a downstream end of the burner at an edge to a combustion chamber where the fuel is to be burnt;

a pilot burner system in the exit ring configured and arranged for injecting liquid fuel into the combustion chamber; and wherein the exit ring comprises a second pilot burner system configured and arranged for injecting pilot gas into the combustion chamber.

2. A burner according to claim 1, further comprising:

a mixing section downstream from the upstream swirl generator and having a downstream end, at least one transfer duct for transferring downstream a flow of combustion air and fuel formed in the upstream swirl generator, and a mixing tube downstream from said at least one transfer duct configured and arranged for receiving said flow from said at least one transfer duct, wherein said downstream end of said mixing section is adjacent to the combustion chamber and is formed by said exit ring.

3. A burner according to claim 2, wherein the mixing tube includes an axis, and wherein the pilot burner system is configured and arranged for injecting the liquid fuel in a plane comprising the mixing tube axis.

4. A burner according to claim 3, wherein the pilot burner system is configured and arranged to inject a jet of liquid fuel tilted away from said mixing tube axis by an angle in the range of 15 degrees to 60 degrees.

5. A burner according to claim 4, wherein said angle is about 25 degrees.

6. A combustion system comprising:

an annular combustion chamber of a gas_turbine unit;

at least two burners according to claim 1 arranged within the combustion chamber.

7. A combustion system according to claim 6, wherein the at least two burners each have one nozzle for injecting liquid fuel for pilot operation.

8. A method for operating an annular combustion chamber of a gas turbine unit in pilot mode, comprising:

providing a combustion system according to claim 6; and supplying each of the nozzles substantially equally with liquid fuel.

9. A combustion system according to claim 6, wherein said at least 2 burners comprises at least 10 burners arranged within the combustion chamber.

10. A method for operating a burner in a heat generator in pilot mode, comprising:

providing a burner according to claim 1; and injecting liquid fuel from the exit ring into the combustion chamber.

11. A method according to claim 10, wherein the burner further includes a mixing section downstream from the upstream swirl generator, a downstream end, at least one transfer duct for transferring downstream a flow of combustion air and fuel formed in the upstream swirl generator, and a mixing tube downstream from said at least one transfer duct and receiving said flow from said at least one transfer duct, wherein said downstream end of said mixing section borders the combustion chamber and is formed by said exit ring.

12. A burner according to claim 1, wherein the exit ring comprises a conical, tilted front surface facing away from the burner axis, and wherein said second pilot burner system is positioned in the exit ring and comprises several injection locations circumferentially distributed around said conical, tilted front surface.

13. A burner useful for operating a heat generator, the burner comprising:

a first upstream swirl generator configured and arranged for swirling a combustion air stream;

means for injecting at least one fuel into the combustion air stream from the upstream swirl generator:

an exit ring located at a downstream end of the burner at an edge to a combustion chamber where the fuel is to be burnt; and a pilot burner system in the exit ring configured and arranged for injecting liquid fuel into the combustion chamber;

a mixing section downstream from the upstream swirl generator and having a downstream end, at least one transfer duct for transferring downstream a flow of combustion air and fuel formed in the upstream swirl generator, and a mixing tube downstream from said at least one transfer duct configured and arranged for receiving said flow from said at least one transfer duct, wherein said downstream end of said mixing section is adjacent to the combustion chamber and is formed by said exit ring;

wherein the mixing tube includes an axis, and wherein the pilot burner system is configured and arranged for injecting the liquid fuel in a plane comprising the mixing tube axis; and wherein the exit ring comprises a conical, tilted front surface facing away from the burner axis and to the combustion chamber, and the pilot burner system includes at least one hole in said tilted front surface for injecting the liquid fuel.

14. A burner according to claim 13, wherein said at least one hole includes only one hole.

15. A burner according to claim 13, wherein said at least one hole is oriented for injection along an axis orthogonal to the tilted front surface.

16. A burner useful for operating a heat generator, the burner comprising:

a first upstream swirl generator configured and arranged for swirling a combustion air stream;

means for injecting at least one fuel into the combustion air stream from the upstream swirl generator;

an exit ring located at a downstream end of the burner at an edge to a combustion chamber where the fuel is to be burnt; and a pilot burner system in the exit ring configured and arranged for injecting liquid fuel into the combustion chamber;

a mixing section downstream from the upstream swirl generator and having a downstream end, at least one transfer duct for transferring downstream a flow of combustion air and fuel formed in the upstream swirl generator, and a mixing tube downstream from said at least one transfer duct configured and arranged for receiving said flow from said at least one transfer duct, wherein said downstream end of said mixing section is adjacent to the combustion chamber and is formed by said exit ring;

a tube configured and arranged for delivering liquid fuel to the pilot burner system, the tube having a downstream end;

a nozzle located at the downstream end of said tube, though which nozzle liquid fuel can be ejected; and means for guiding air to holes in the exit ring though which holes a jet generated by said nozzle can enter the combustion chamber.

17. A burner according to claim 16, further comprising:

means, upstream of said nozzle in the tube, for generating turbulence in the flow of liquid fuel in the tube.

18. A burner according to claim 17, wherein said means comprises at least one turbulence generator with at least two holes though which the liquid fuel must pass.

19. A burner according to claim 16, further comprising:

a tilted endplate terminating the tube;

wherein the exit ring comprises a conical, tilted front surface facing away from the burner axis and to the combustion chamber, and the pilot burner system includes at least one hole in said tilted front surface for injecting the liquid fuel; and wherein said nozzle is located in said tilted endplate.

20. A burner according to claim 19, wherein the endplate comprises an end cone extending into the hole downstream of the tube and wherein the axis of the cone is substantially aligned with the axis of the hole.

21. A burner according to claim 19, wherein the tilted endplate is substantially parallel to the tilted front surface.

22. A burner according to claim 16, wherein said means for guiding air comprises an annular air channel in the exit ring.

23. A combustion system comprising:

an annular combustion chamber of a gas turbine unit;

at least two burners arranged within the combustion chamber, each of said at least two burners including a first upstream swirl generator configured and arranged for swirling a combustion air stream, means for injecting at least one fuel into the combustion air stream from the upstream swirl generator, an exit ring located at a downstream end of the burner at an edge to a combustion chamber where the fuel is to be burnt, a pilot burner system in the exit ring configured and arranged for injecting liquid fuel into the combustion chamber; and a nozzle for injecting liquid fuel for pilot operation;

wherein the radial position of said nozzle within each of said at least two burners, with respect to the radial position of each said burner within the annular combustion chamber, is the same for all nozzles.

* * * * *